United States Patent [19]

Dea

[11] 4,413,784

[45] Nov. 8, 1983

[54] CONSTANT-OUTPUT ATOMIZER

[75] Inventor: Jack Y. Dea, Reno, Nev.

[73] Assignee: The United States of America as represented by the Administrator of the National Aeronautics and Space Administration, Washington, D.C.

[21] Appl. No.: 308,203

[22] Filed: Oct. 2, 1981

[51] Int. Cl.[3] ..... B05B 7/08

[52] U.S. Cl. ..... 239/426

[58] Field of Search ..... 239/310, 318, 418, 426, 239/434

[56] References Cited

U.S. PATENT DOCUMENTS

| | | | |
|---|---|---|---|
| 535,000 | 3/1895 | Goodman | 239/426 |
| 909,190 | 1/1909 | Keller | 239/418 |
| 1,524,990 | 2/1925 | Macaulay | 239/418 |
| 1,636,353 | 7/1927 | Bullum | 239/434 |
| 2,062,097 | 11/1936 | Lingard | 239/318 |
| 2,149,526 | 3/1939 | Johnson | 239/418 |
| 2,253,071 | 8/1941 | Gordon et al. | 239/426 |
| 2,582,805 | 1/1952 | Trumbour et al. | 239/426 |
| 3,591,088 | 7/1971 | Green | 239/426 |

FOREIGN PATENT DOCUMENTS

| | | | |
|---|---|---|---|
| 558890 | 7/1957 | Belgium | 239/426 |
| 32417 | 10/1964 | German Democratic Rep. | 239/434 |

*Primary Examiner*—John J. Love
*Assistant Examiner*—Michael J. Forman
*Attorney, Agent, or Firm*—Joseph H. Beumer; John R. Manning; Leon D. Wofford, Jr.

[57] ABSTRACT

An improved constant-output atomizer (30) includes a body (38) which has a generally frustoconical expansion nozzle (36) for producing an air jet when a supply of pressurized air is connected to the nozzle upstream of the throat of the nozzle. A liquid feed line (40) supplies liquid to be atomized by the air jet, and the body includes a groove (42) which opens into the diffuser section of the nozzle downstream of the throat for conducting liquid from the feed line to the nozzle. The groove extends in a direction perpendicular to the axis of the nozzle, and radially with respect thereto; and it has a depth approximately equal to half the axial length of the nozzle. Liquid, conducted by capillary action in the groove to the nozzle, is atomized into a fine mist by the air jet in the nozzle; and the groove eliminates fluctuations in spray order.

6 Claims, 3 Drawing Figures

CONSTANT-OUTPUT ATOMIZER

ORIGIN OF THE INVENTION

The invention described herein was made in performance of work under a NASA contract, and is subject to the provisions of Section 305 of the National Aeronautics and Space Act of 1958, Public Law 85-568 (72 SCAT.435; 42 U.S.C. 2457).

TECHNICAL FIELD OF THE INVENTION

The present invention generally relates to an atomizer which is adapted to produce a substantially constant output and minimize fluctuation in the concentration of droplets produced.

BACKGROUND ART

Fine-mist atomizers are used to generate aerosols for scientific experiments, inhalation therapy, and aerosol research. Most of these applications, however, require a substantially constant output, i.e., a concentration that remains substantially time-invariant as to droplet size, mass flow, and concentration. Conventional atomizers usually have unstable outputs, and are thus unsatisfactory for the purposes and uses listed above. It is, therefore, an object of the present invention to provide a new and improved atomizer capable of producing a substantially constant output.

DISCLOSURE OF THE INVENTION

An improved constant-output atomizer according to the present invention includes a body having an expansion nozzle for producing an air jet when a supply of pressurized air is connected to the nozzle upstream of the nozzle throat, and a groove in the housing opening into the nozzle downstream of the throat for supplying liquid to be atomized by the air jet.

The liquid flows smoothly to the air jet due to the capillary action that takes place in the groove and the suction present at the open end of the groove. Furthermore, the open groove prevents localized solid residues which would interfere with the rate at which liquid is delivered to the atomizer; and the conical nature of the nozzle eliminates any liquid build-up which, if present, would be swept away periodically by the air jet, causing fluctuations in the output of the atomizer, even if the rate of liquid input to the air jet were constant. Thus, the combination of nozzle and groove serves to inhibit any factor that would perturb the output of the atomizer. Moreover, the atomizer according to the present invention is attitude-insensitive, and is capable of operating with any liquid whose viscosity is not excessive. A stable output can be expected after about 5 minutes of operation.

In one preferred form of the invention, the groove is located radially with respect to the nozzle axis; and the width of the groove is approximately twice the diameter of the throat of the nozzle. In addition, the depth of the groove is about equal to half of the axial length of the nozzle. These dimensions are not, however, critical.

BRIEF DESCRIPTION OF THE DRAWINGS

An embodiment of the invention is shown in the accomanying drawings, wherein.

DETAILED DESCRIPTION OF THE PREFERRED EMBODIMENTS

Figure 1:
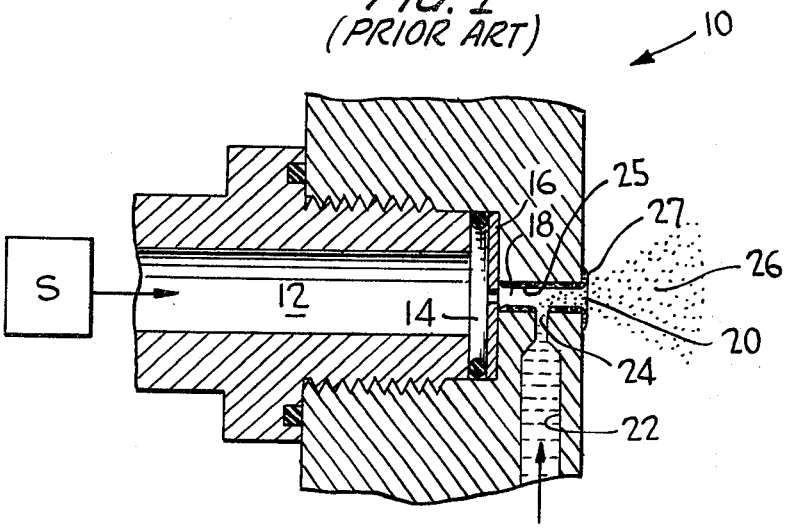
FIG. 1 (PRIOR ART)
FIG. 1 is a sectional view of a prior art atomizer.

Referring now more specifically to FIG. 1, reference numeral 10 designates a prior art atomizer which includes generally cylindrical conduit 12 for connection to source S of compressed air. The conduit terminates in air exit 14 which is covered by jet orifice plate 16; through which compressed air is directed outwardly into generally cylindrical aperture 18 that functions as a nozzle, and terminates in free end 20. Liquid from a supply (not shown) is supplied via feed line 22 that terminates in a relatively narrow exit orifice 24 located in the bottom surface of aperture 18. Air from supply S passing through aperture 18 mixes with liquid exiting from orifice 24, thereby atomizing the liquid into a spray 26 which is directed outwardly from the aperture.

As discussed above, a prior art atomizer such as that shown in FIG. 1 suffers from several major disadvantages. One is that exit orifice 24 at the end of the liquid feed line, which terminates adjacent to the bottom of the aperture, must be so small that it frequently becomes blocked or partially obstructed by solid residue, such as salt. Over a period of time, residue build-up reduces liquid flow into the nozzle, and thus the output of the atomizer changes with time. Additionally, as seen from FIG. 1, liquid directed to the nozzle by the feed line tends to collect both along the bottom of the generally cylindrical aperture, as indicated at 25, and also at annular region 27, surrounding aperture 18. The collected liquid eventually builds up to a level at which the jet of air passing through aperture 18 sweeps the collected liquid into spray 26, causing a momentary perturbation in the volumetric output of the atomizer.

Figure 2:
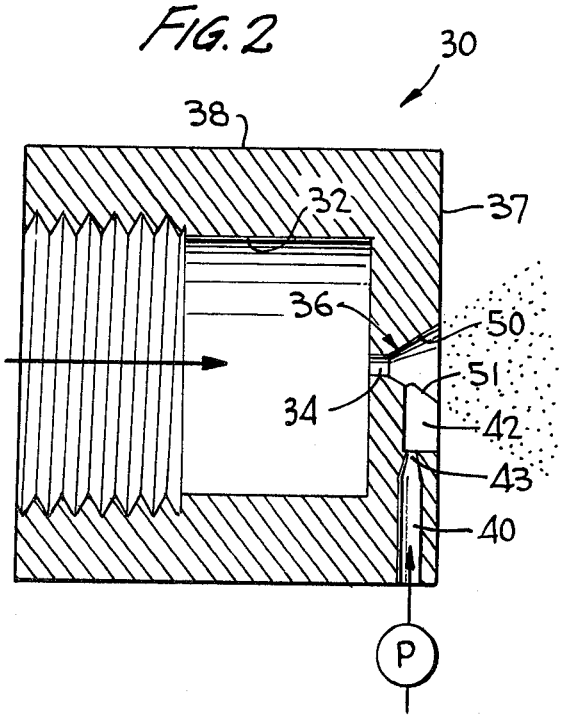
FIG. 2 is a sectional view of an improved constant-output atomizer formed in accordance with the present invention.

FIG. 2 illustrates in detail the present improved constant-output atomizer 30. Body 38 of the atomizer has a cylindrical air supply conduit 32, which terminates in expansion nozzle 36 having generally cylindrical exit orifice 34, defining the throat of the nozzle, and frustoconical diffuser section 50 that terminates at end face 37 of atomizer head 38. The nozzle throat can be, e.g., a No. 78 drill hole. The conical walls of this expansion nozzle prevent any build-up of liquid, which continuously drains. Liquid, pressurized by pump P, is fed via conduit 40 in the atomizer head to orifice 43 located at the closed end of groove 42 that opens at 51 into diffuser section 50 of nozzle 36. The groove thus fluidically connects frustoconical expansion nozzle 36 to orifice 43 of the liquid feed line.

Figure 3:
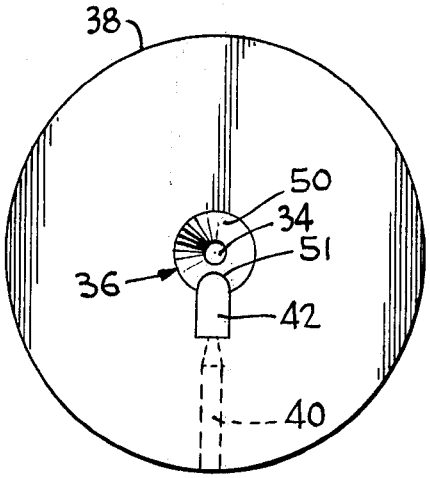
FIG. 3 is a front elevation of the improved constant-output atomizer of FIG. 2.

As shown in FIG. 2, groove 42 has a depth about half the axial length of diffuser section 50; and the groove extends in a direction perpendicular to the axis of the nozzle and radially with respect thereto, as shown in FIG. 3. The width of the groove (FIG. 3) is approximately twice the diameter of the nozzle throat.

As one example, the diameter of the body is ½ inch, and its length is also ½ inch. The width of the groove in this example is 0.025 inch, and its length is 0.05 inch.

In operation, pressurized air supplied via conduit 32 enters the throat of the nozzle, and, in expanding, atomizes liquid in open end 51 of the groove. Liquid is precisely channelled into the expanding air jet as a result of the structure of the nozzle, groove, and air jet exit orifices, due to capillary action of the liquid in the groove and the suction or pressure drop caused by the nozzle. The amount of liquid delivered to the nozzle via the feed line and the channel is closely controlled by a precise metering pump. The suction created at open end 51 by the action of diffuser section 50 eliminates accumulation of liquid, and eliminates a major cause of spray instability.

The atomizer can operate equally well in any position, and will atomize any solution not excessively viscous. A generally uniform output is achieved using the atomizer after approximately five minutes of operation.

The atomizer is preferably used in combination with a liquid pump and a suitable source of dry, clean air, e.g., tank air or filtered and compressed air. When used in aerosol research, the atomizer is preferably mounted within a housing that channels the atomized mist to a dryer in order to evaporate the atomized droplets to thereby provide dry particles. One preferred aerosol-generating system also includes a neutralizer, an electrostatic classifier for classifying the size of the aerosol, and an electrostatic aerosol detector to count the number of particles in the mist. Such equipment is commercially available from Thermosystems, Inc. of St. Paul, Minn.

The improved constant-output atomizer has been used successfully between 10 p.s.i. and 100 p.s.i., with the use of higher pressures permitting the attainment of finer mists. The preferred range for liquid input is 0.05 cc/min to 2.0 cc/min; the larger the liquid flow, the greater the formation of relatively large drops in the atomized spray.

Recommended operation of the atomizer includes initially supplying air through the exit orifice 34, and thereafter supplying liquid to the groove. By proceeding in this fashion, liquid will be prevented from entering orifice 34. To terminate operation, the liquid is first shut off, and thereafter the air supply cut off, in order to minimize or entirely prevent excess liquid from collecting and being retained within the nozzle. After use, it is preferable to wash and clean the apparatus with fresh water.

The improved constant-output atomizer can be used to generate aerosols in cloud-physics experiments, e.g., in experiments such as those which are being proposed for use in the space shuttle. The atomizer can also be used in inhalation therapy and in aerosol research, both of which require a stable output of droplets from an atomizer. Further, the uniform, steady mist produced by the atomizer can be used to deliver an even and thin coating to desired surfaces.

By using the atomizer to produce a very fine atomized mist, any dried particles, e.g., NaCl, which are present will be quite small, e.g., of sub-micron size; such particles are quite useful in cloud-physics studies. Further advantages are attained by using the atomizer in inhalation therapy, where the efficiency of a drug being introduced into the lungs increases in proportion to the fineness of the mist inhaled by the lungs.

In tests which compared the atomizer of FIG. 1 with the atomizer of FIG. 2, the output of the present atomizer was determined to be relatively constant, whereas the output of the atomizer of FIG. 1 produced a droplet output which varied over a larger range within a similar time. Additionally, the test results determined that the peak concentration of droplet size occurs at a droplet diameter of approximately 1 micron. This provides a fine mist, which is advantageous, as described above.

From the foregoing description, one skilled in the art can easily ascertain the essential characteristics of this invention, and, without departing from the spirit and scope thereof, can make various changes and modifications of the invention to adapt it to various usages and conditions.

What is claimed is:

1. An improved constant-output atomizer comprising:

a body containing an air supply conduit;

an expansion nozzle formed in the wall of one end of said body, said expansion nozzle having a longitudinal axis, said nozzle comprising an exit orifice connected to said air supply conduit and a frustoconical diffuser section connecting said exit orifice to the outside surface of said end of said body, said frustoconical diffuser section widening from a narrow upstream end to a widened downstream end, said upstream end being contiguous with said exit orifice and of the same size as said exit orifice to form a smooth, continuous transition from said exit orifice to said frustoconical diffuser section;

a transverse groove cut in the surface of said end of said body, one end of said groove connecting with and extending into the side of said frustoconical diffuser section;

a liquid conduit formed in the wall of said one end of said body;

a metering pump connected to one end of said liquid conduit for moving liquid to said atomizer at a precise and constant rate;

an orifice for liquid connected to the opposite end of said liquid conduit, said liquid orifice connecting said liquid conduit to said transverse groove;

whereby liquid expelled from said orifice for liquid travels in a stream down the length of said transverse groove into said diffuser section where it combines with air expelled from said exit orifice and is atomized to produce a constant output.

2. An improved constant-output atomizer in accordance with claim 1, wherein said exit orifice is cylindrical and said exit orifice and said frustoconical diffuser section are symmetrical about said longitudinal axis of said nozzle, said axis extending longitudinally through said exit orifice and longitudinally through said diffuser section and being perpendicular to said outer surface of said end of said body.

3. An improved constant-output atomizer in accordance with claim 2 wherein said transverse groove is directed perpendicular to the longitudinal axis of said nozzle.

4. An improved constant-output atomizer in accordance with claim 3 wherein said transverse groove is radially located with respect to said nozzle longitudinal axis.

5. An improved constant-output atomizer in accordance with claim 4 wherein the depth of said transverse groove is approximately half of the axial length of said nozzle.

6. An improved constant-output atomizer in accordance with claim 5 wherein the width of said transverse groove is approximately equal to twice the diameter of said exit orifice.

* * * * *